US010565830B1

(12) United States Patent
Georgilas et al.

(10) Patent No.: US 10,565,830 B1
(45) Date of Patent: Feb. 18, 2020

(54) GAMING SYSTEM INCLUDING CLAW APPARATUS AND METHOD OF USING THE SAME

(71) Applicant: First Gaming Group, LLC, Las Vegas, NV (US)

(72) Inventors: Justin Tilemahos Georgilas, Las Vegas, NV (US); Evgeny Bronnikov, Novosibirsk (RU)

(73) Assignee: First Gaming Group, LLC, Las Vegas, NV (US)

( * ) Notice: Subject to any disclaimer, the term of this patent is extended or adjusted under 35 U.S.C. 154(b) by 0 days.

(21) Appl. No.: 15/642,212

(22) Filed: Jul. 5, 2017

Related U.S. Application Data

(60) Provisional application No. 62/358,338, filed on Jul. 5, 2016.

(51) Int. Cl.
*G07F 17/32* (2006.01)

(52) U.S. Cl.
CPC ..... *G07F 17/3297* (2013.01); *G07F 17/3216* (2013.01); *G07F 17/3246* (2013.01); *G07F 17/3267* (2013.01)

(58) Field of Classification Search
CPC .... A63F 9/30; G07F 17/3297; G07F 17/3216; G07F 17/3246; G07F 17/3267
USPC ..... 463/25
See application file for complete search history.

(56) References Cited

U.S. PATENT DOCUMENTS

2004/0018865 A1* 1/2004 Gilmore ..... A63F 9/30 463/7
2005/0119041 A1* 6/2005 Berman ..... G07F 17/32 463/16
2008/0182643 A1* 7/2008 Seelig ..... G07F 17/3202 463/20
2009/0191931 A1* 7/2009 Peck ..... G07F 17/32 463/7
2011/0272887 A1* 11/2011 McGrath ..... A63F 9/30 273/448
2013/0231166 A1* 9/2013 Riggles ..... A63F 9/30 463/7
2014/0087819 A1* 3/2014 Rakestraw ..... G07F 17/3255 463/20

* cited by examiner

*Primary Examiner* — Allen Chan
(74) *Attorney, Agent, or Firm* — FisherBroyles, LLP; Rob L. Phillips

(57) ABSTRACT

A gaming system including one or more gaming devices (e.g., slot machines) and a claw apparatus. In a physical version, the claw apparatus acts a skill-based bonus game during which players attempt to grab prizes (e.g., cash) during a pre-established time period. In a cash version, the currency remains in a chamber and the amount collected using the moveable claw is tracked using RFID technology or other technology. In one version, the claw apparatus forms part of a game device bank comprising multiple gaming devices. In a video version, the claw apparatus may be depicted on a gaming device display on which players may touch the display to collect virtual prizes or cash.

9 Claims, 7 Drawing Sheets

GAMING SYSTEM INCLUDING CLAW APPARATUS AND METHOD OF USING THE SAME

CROSS-REFERENCE

This application claims priority to U.S. Application No. 62/358,338 filed Jul. 5, 2016 and which is incorporated herein for all purposes.

FIELD OF THE INVENTION

The embodiments of the present invention relate to a gaming system including a gaming device in communication with a crane or claw apparatus used as a bonus game.

BACKGROUND

Gaming continues to grow throughout the United States. The primary area of growth in recent years relates to slot machines and related electronic casino games, including skill-based games. Skill-based games have been approved by numerous states, including Nevada.

Moreover, slot machines and other electronic gaming devices can become stale after being on the casino floor for long periods of time.

Thus, it would be advantageous to develop new, exciting gaming devices with or without skill-based features.

SUMMARY

The embodiments of the present invention are directed to a gaming system including one or more gaming devices (e.g., slot machines) and a crane or claw apparatus. In a physical embodiment, the claw apparatus acts a skill-based bonus game during which players attempt to grab prizes (e.g., cash) during a pre-established time period. In a cash embodiment, real or fake currency is retained in a chamber while the player uses the claw to grab as much currency as possible. The amount of cash collected using the claw is tracked using RFID technology.

In one embodiment, the claw apparatus forms part of a game bank comprising multiple gaming devices linked to a single claw apparatus. In a video embodiment, the claw apparatus may be depicted on a gaming device display on which players may touch the display to collect virtual prizes or cash.

Other variations, embodiments and features of the present invention will become evident from the following detailed description, drawings and claims.

DETAILED DESCRIPTION

Figure 1:
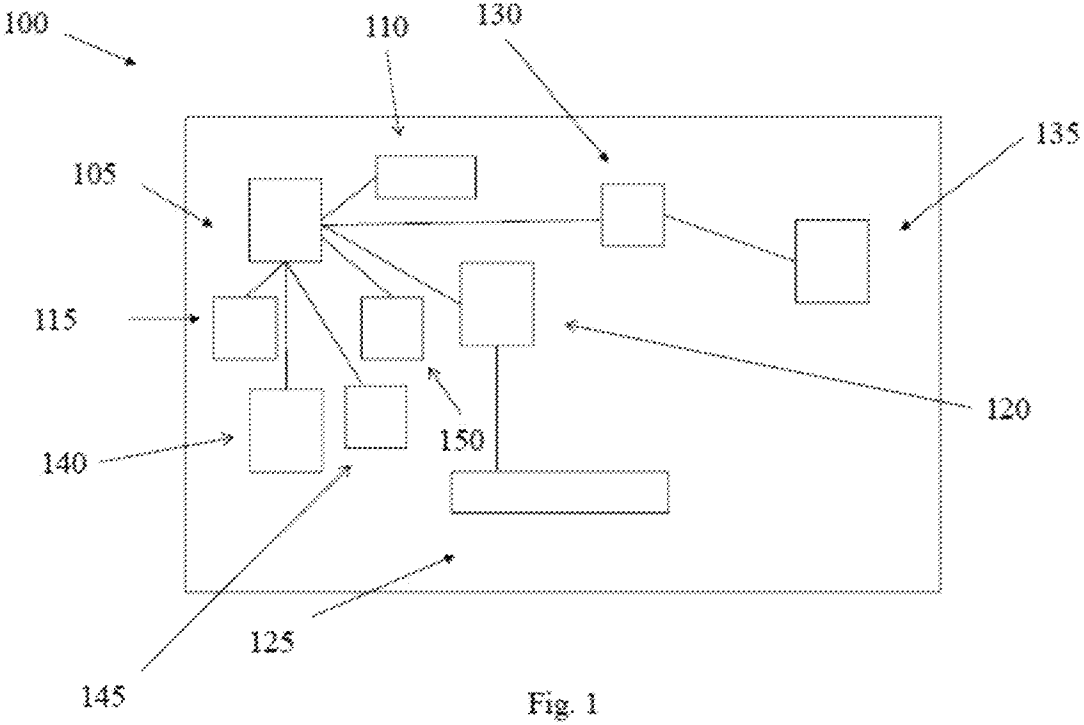
FIG. 1 illustrates a block diagram of components of an electronic gaming device for conducting a game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

The embodiments of the present invention may be facilitated by an electronic gaming device whereby a single player plays against the electronic gaming device's processor as described herein. The electronic gaming device may be a standalone device and bar-top device forming part of a gaming device network or not. A block diagram of the electronic gaming device 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming device 100 may be linked to a central game server which allows players to select from a number of games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
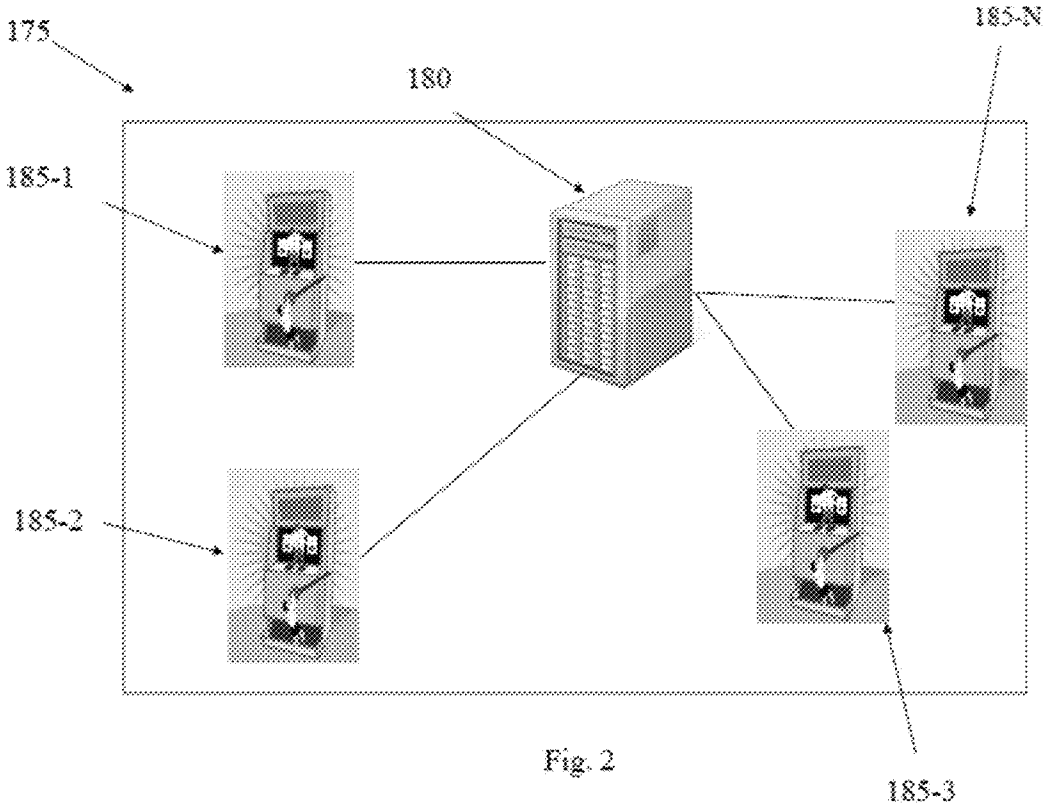
FIG. 2 illustrates a block diagram of a gaming network including numerous slot machines according to the embodiments of the present invention.

FIG. 2 shows a block diagram of a gaming network 175 which may be used to facilitate play of the game via linked gaming devices according to the embodiments of the present invention. The gaming network 175 comprises a central processor 180 (e.g., processor-equipped game server) in communication with multiple gaming devices 185-1 through 185-N as described in FIG. 1.

Figure 3:
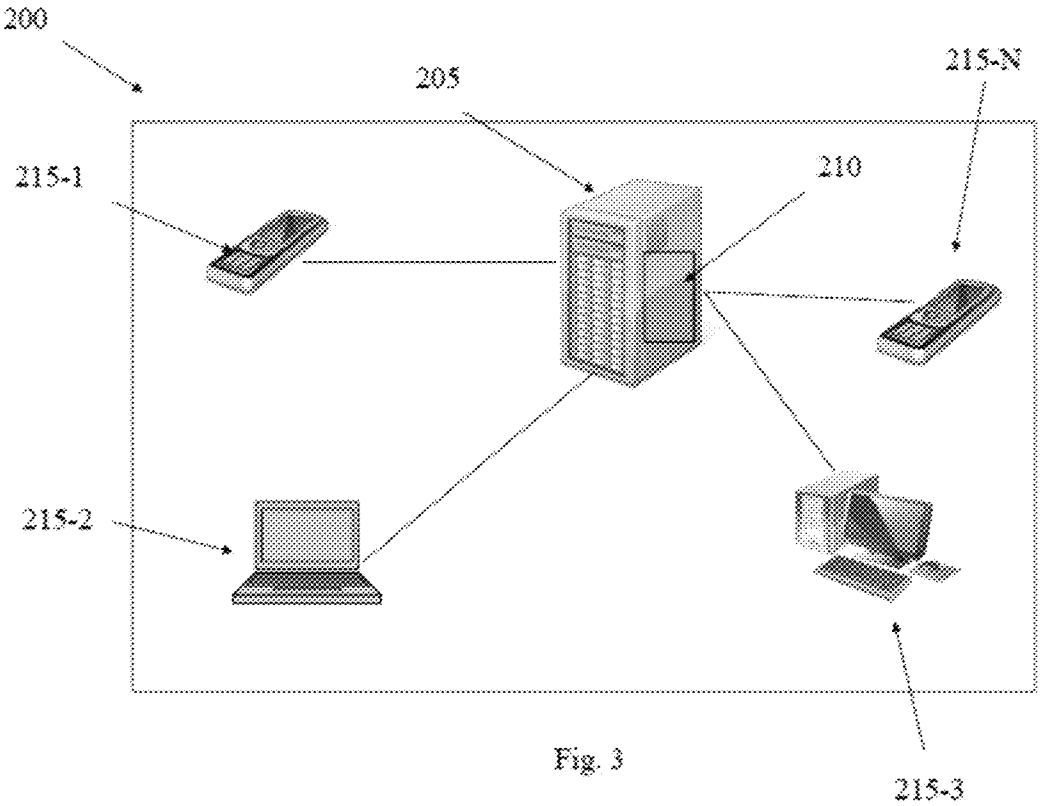
FIG. 3 illustrates a block diagram of a wireless network system accessible by mobile devices for conducting mobile games of chance according to the embodiments of the present invention.

FIG. 3 shows a block diagram of a wireless system 200 which may be used to facilitate remote play of the game according to the embodiments of the present invention. The wireless network system 200 comprises a processor-equipped game server 205, including one or more processors 210 running game software, and remote devices 215-1 through 215-N (e.g., smart phones) configured to access said game server 205 facilitating game play on the remote devices 215-1 through 215-N. In another embodiment, the video game according to the embodiments of the present invention may be in the form of a software application ("App") downloadable onto smart phones, tablets or computers and playable via processing power and a user interface associated therewith.

Figure 4:
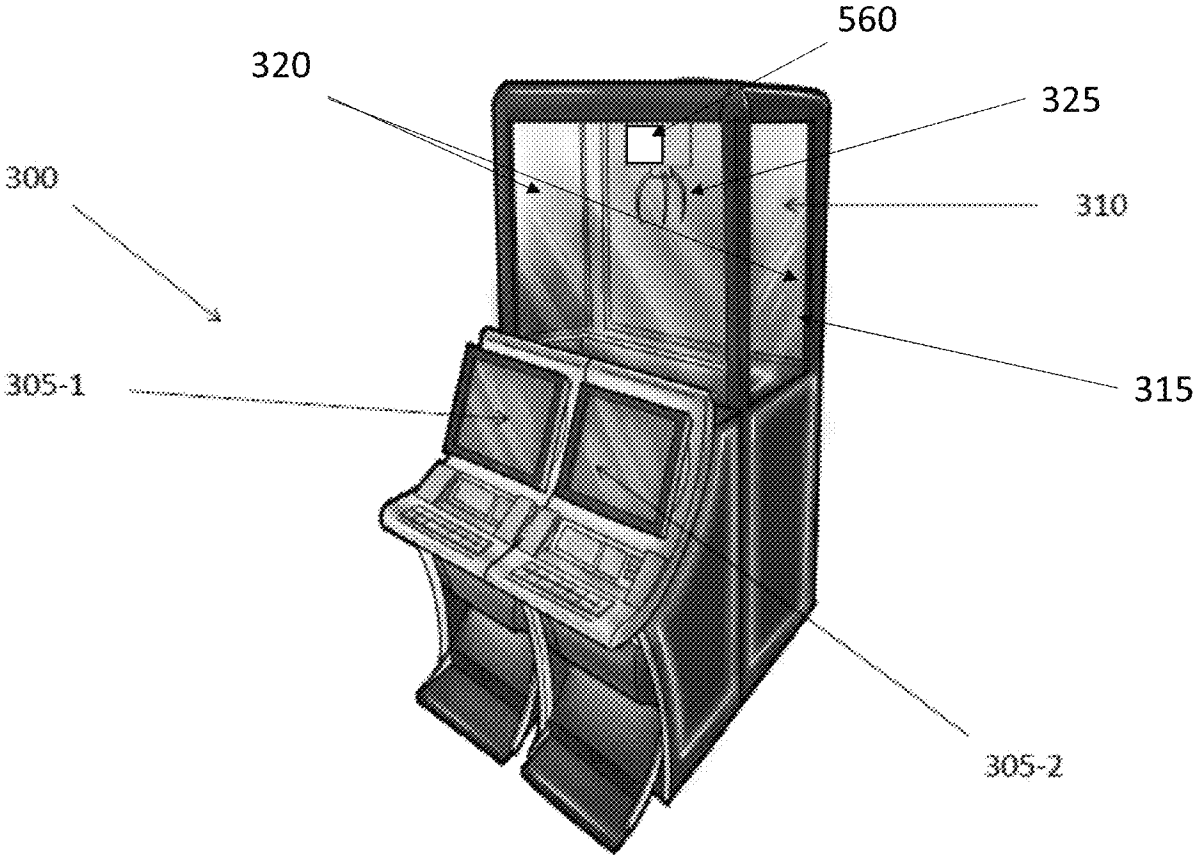
FIG. 4 illustrates a gaming system including multiple gaming devices and a claw apparatus according to the embodiments of the present invention.

FIG. 4 illustrates a gaming system 300 comprising two gaming devices 305-1, 305-2 and a claw apparatus 310. The gaming devices 305-1, 305-1 may be any game type including slots, video poker, bingo, keno, blackjack, etc., and may be the same game or different games. The gaming system 300 may also incorporate other than two gaming devices. While shown as a single unit, in another embodiment, the gaming devices 305-1, 305-2 may be remote from the claw apparatus 310. In such an embodiment, the gaming devices 305-1, 305-2 may control the claw apparatus 310 via a wired or wireless connection.

The claw apparatus 310 includes a chamber 315, defined by transparent walls 320, and a moveable claw 325. The moveable and graspable claw 325 may be selectively positioned along an upper portion of the chamber 315 and, once positioned, dropped into a pile of tangible items (e.g., stuffed animals, cash, etc.) where the claw 325 closes or grasps automatically and returns to its home position with or without a tangible item(s). In one embodiment, as detailed below, the chamber 315 retains different values of currency which the claw 325 is configured to capture. The claw 325 may be any item capable of capturing the prizes in the chamber 315 and may incorporate tacky surfaces and/or suction to better capture the prizes.

Figure 6:
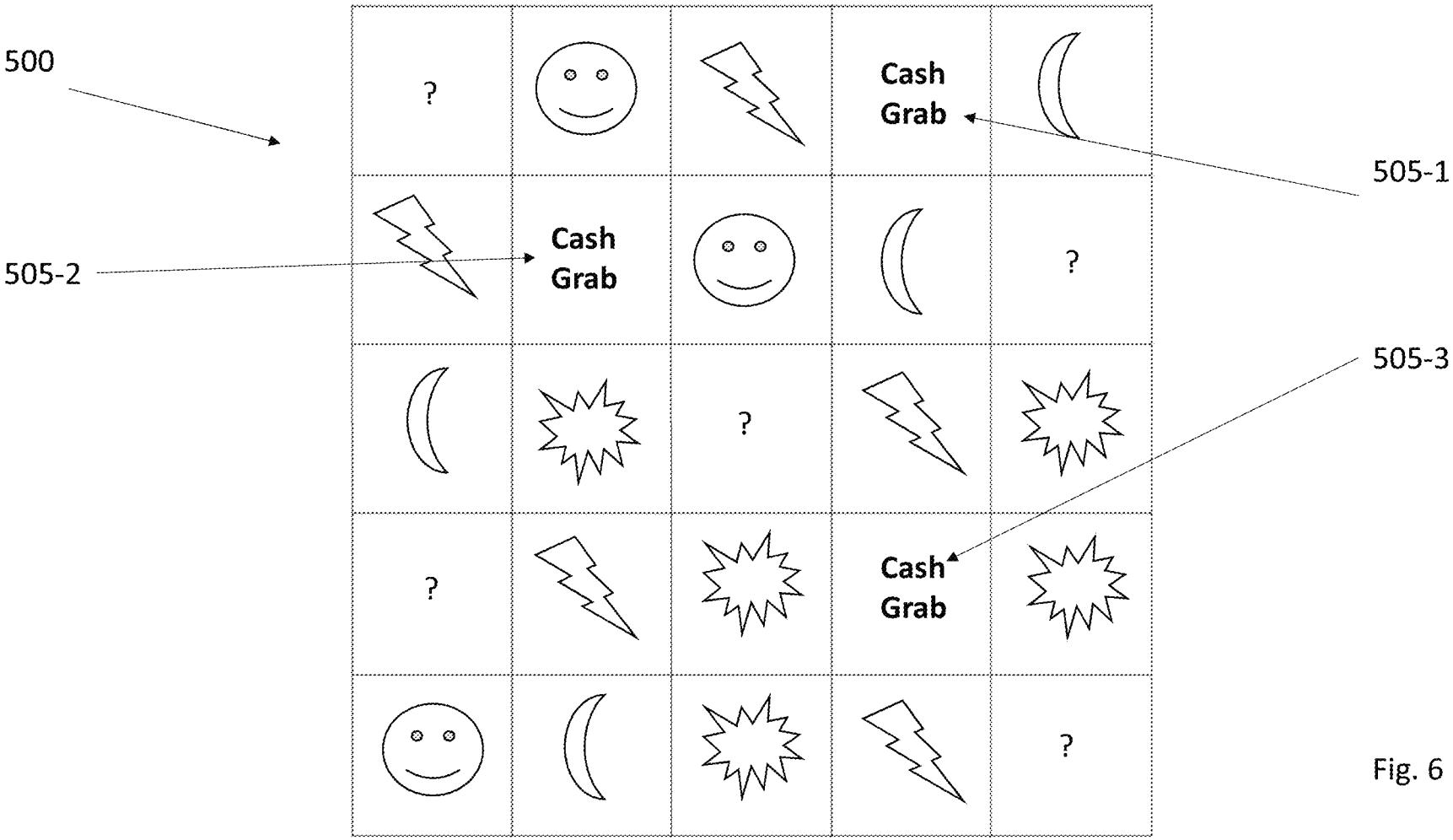
FIG. 6 illustrates a video slot machine display according to the embodiments of the present invention.

In one embodiment, the gaming devices 305-1, 305-2 are five-reeled, video slot machines. Select cash grab symbols trigger a bonus game involving the claw apparatus 310, namely the moveable claw 325. In one embodiment, as shown in FIG. 6, a slot machine video display 500 depicts three cash grab bonus symbols 505-1 and 505-3 on reels 2, 3 and 4 triggering the bonus game (i.e., scatter). Those skilled in the art will recognize that other slot game outcomes may trigger the bonus game. Once the bonus game is triggered, the player is given control of the moveable claw 325 via a user interface (e.g., touchscreen display) of the respective gaming device 305-1, 305-2.

Figure 7:
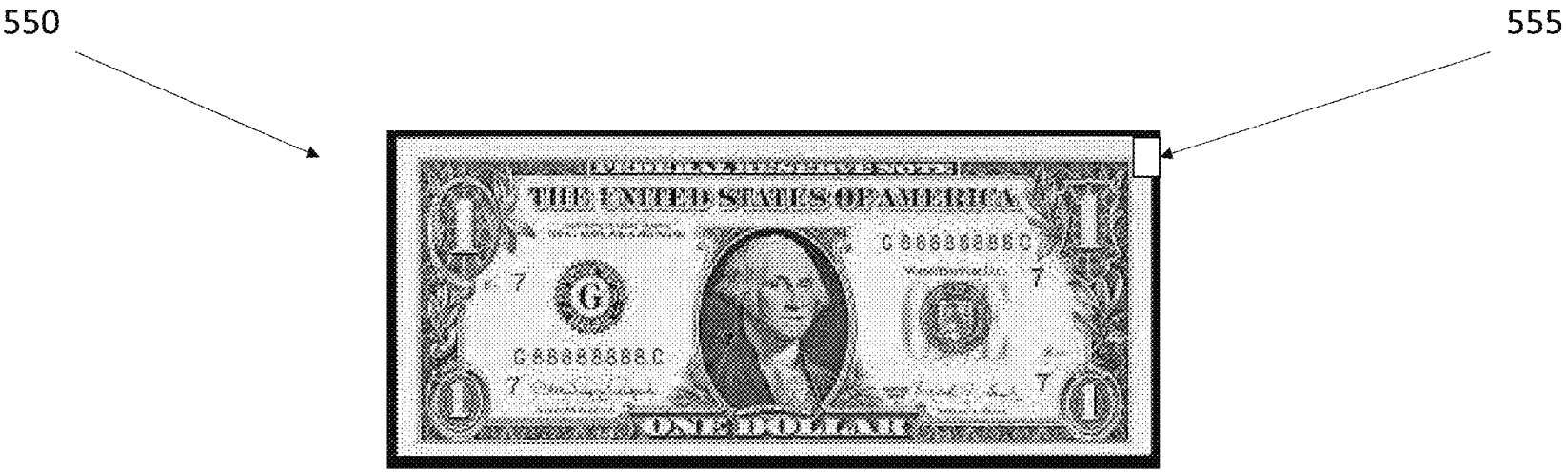
FIG. 7 illustrates currency with an integrated RFID tag according to the embodiments of the present invention.

In a first embodiment, cash in the form of bills or currency of different denominations is retained in the chamber 315. A pressurized air source or fan may circulate the currency within the chamber 315 allowing the player to attempt to capture it with the moveable claw 325. The currency may also remain unagitated on a floor of the chamber 315 such that the player may cause the moveable claw 325 to drop into the currency and close in an attempt to capture currency. In either embodiment, as shown in FIG. 7, each bill 550 incorporates RFID tags 555 readable by a RFID reader 560 proximate to the moveable claw 325 or elsewhere in the chamber 315. The RFID reader 560 is configured to read the RFID tags 405 and determine the value of each bill captured by the moveable claw 325.

The captured cash may be automatically deposited into a segregated bin or container within the chamber 315 where it is counted via the RFID reader 560 and tags 555, or imaging capturing technology (i.e., camera and software) configured to read values off the bills, or code readers configured to read bar codes or QR codes on the bills. Those skilled in the art will recognize that other technologies may be used to identify the value of the bills captured by the claw 325. Once the currency is valued, the system 300 causes the currency to be returned to the chamber 315.

In a class II version of the gaming system 300, currency and a random number generator predetermine the bonus prize as facilitated by the moveable claw 325. In such an embodiment, the gaming system 300 first determines the bonus award and then purposefully determines the value of the captured currency to match the pre-determined bonus award no matter which bills the player captures.

In an electronic embodiment, the skill-based bonus feature comprises money falling on a display and the player must touch the falling money to be awarded a prize.

Figure 5:
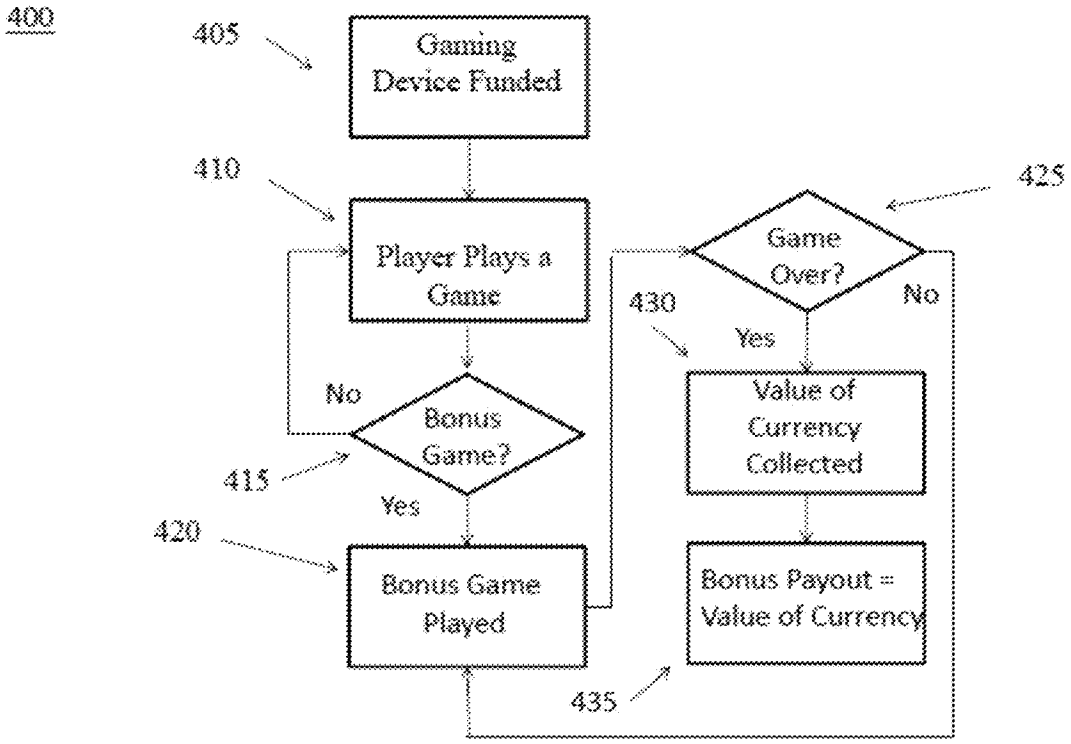
FIG. 5 illustrates a flow chart detailing one methodology for conducting a game according to the embodiments of the present invention.

FIG. 5 shows a flow chart 400 detailing a method conducting a skill-based game according to the embodiments of the present invention. At 405, a player inserts currency, coupon or voucher, or uses stored credits, to fund play of games on one of the gaming devices 305-1, 305-2 in communication with the crane apparatus 310. At 410, the player plays a game on one of the gaming devices 305-1, 305-2. At 415, it is determined whether the game play outcome triggered the bonus game. If not, the flow chart 400 loops back to 410. If a bonus game is triggered, at 420, the bonus game is played during which the player seeks to collect currency using the moveable claw 325. Playing the bonus game comprising the player controlling movement of the claw 325 in a horizontal two-dimensional plane and when in a desired position, causing the claw 325 to drop and grab prizes (e.g., bills). The player may be provided one or more such opportunities during a bonus game. In one embodiment, the claw 325 automatically drops and grabs if the player fails to instruct within an allotted time period (e.g., 15 seconds). At 425, it is determined if the bonus game is over. If not, the flow chart loops back to 420. If the bonus game is over, at 430, it is determined, using the RFID or other technology, a value of the bills collected. At 435, the player is awarded the bonus commensurate with the value of the currency collected.

In an embodiment with tangible prizes, such as stuffed animals, boxed jewelry, memorabilia, etc., the claw apparatus may have a slot through which the prize is provided to the player or the prize may be identified by the system 300 using RFID, technology, image capturing technology, scanner technology or the like and dispensing a ticket to be redeemed for the captured prize.

Although the invention has been described in detail with reference to several embodiments, additional variations and modifications exist within the scope and spirit of the invention as described and defined in the following claims.

We claim:

1. A gaming system comprising:

a single unit formed of:

a plurality of gaming devices, each of said plurality of gaming devices having at least a display, user interface and memory, each gaming device in communication with a processor; and a claw apparatus comprising a chamber and a moveable claw, said chamber retaining one or more prizes in the form of real or fake currency, said plurality of gaming devices positioned proximate at least a front side of said claw apparatus with said claw apparatus chamber and moveable claw visible by players from gaming device seats;

wherein said claw apparatus is triggered responsive to one or more pre-established outcomes of said plurality of gaming devices, said moveable claw controlled via said user interface of each of said plurality of gaming devices to move horizontally in a two-dimensional plane and drop and capture one or more prizes in the form of real or fake currency when instructed to by said player;

a segregated bin configured to (i) receive real or fake currency captured by said claw from said chamber, said segregated bin including one or more RFID readers, image capturing technology or code readers for identifying a value of said captured real or fake currency and (ii) return said captured real or fake currency to said chamber once said value is identified; and means for awarding said value of said captured real or fake currency to a player of said gaming device.

2. The gaming system of claim 1 wherein a captured prize value is based on player skill.

3. The gaming system of claim 1 wherein a captured prize value is randomly determined.

4. The gaming system of claim 1 wherein said claw includes at least one of suction and tacky surfaces.

5. The gaming system of claim 1 wherein said claw apparatus includes a prize slot.

6. A gaming system comprising:

a single unit formed of:

a plurality of gaming devices, each of said plurality of gaming devices having at least a display, user interface and memory, each gaming device in communication with a processor; and a claw apparatus comprising a chamber and a moveable claw, said chamber retaining currency in the form of a plurality of bills of different denominations, said plurality of gaming devices positioned proximate at least a front side of said claw apparatus with said claw apparatus chamber and moveable claw visible by players from gaming device seats;

wherein said claw apparatus is triggered responsive to one or more pre-established outcomes of said a plurality of gaming devices, said moveable claw controlled via said user interface of each of said a plurality of gaming devices to move horizontally in a two-dimensional plane and drop and capture one or more of said plurality of real or fake currency when instructed to by said player;

a segregated bin configured to (i) receive real or fake currency captured by said claw from said chamber, said segregated bin including one or more RFID readers, image capturing technology or code readers for identifying a value of said captured real or fake currency and (ii) return said captured real or fake currency to said chamber once said value is identified; and means for awarding said value of said captured real or fake currency to a player of said gaming device.

7. The gaming system of claim 6 wherein said claw includes at least one of suction and tacky surfaces.

8. The gaming system of claim 6 wherein said claw apparatus further comprises a segregated container within said chamber for receiving captured bills to be valued.

9. The gaming system of claim 6 wherein said claw apparatus further comprises an air source for agitating said plurality of bills in said chamber.

* * * * *